US007600585B2

(12) United States Patent
Patton et al.

(10) Patent No.: US 7,600,585 B2
(45) Date of Patent: Oct. 13, 2009

(54) COILED TUBING DRILLING RIG

(75) Inventors: Bartley J. Patton, Sugar Land, TX (US); Matthew D. Rouse, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 15 days.

(21) Appl. No.: 11/419,100

(22) Filed: May 18, 2006

(65) Prior Publication Data

US 2006/0260844 A1 Nov. 23, 2006

Related U.S. Application Data

(60) Provisional application No. 60/682,560, filed on May 19, 2005, provisional application No. 60/691,301, filed on Jun. 16, 2005.

(51) Int. Cl.
*E21B 19/00* (2006.01)
*E21B 15/00* (2006.01)

(52) U.S. Cl. ..... 175/57; 175/162; 175/203; 166/384; 166/77.2

(58) Field of Classification Search ..... 166/384, 166/77.1, 77.2; 175/57, 162, 203
See application file for complete search history.

(56) References Cited

U.S. PATENT DOCUMENTS

| | | | | |
|---|---|---|---|---|
| 5,842,530 | A | 12/1998 | Smith | |
| 6,003,598 | A | 12/1999 | Andreychuk | |
| 6,332,501 | B1 | 12/2001 | Gipson | |
| 6,408,955 | B2 | 6/2002 | Gipson | |
| 6,502,641 | B1 | 1/2003 | Carriere | |
| 6,973,979 | B2 | 12/2003 | Carriere | |
| 7,140,445 | B2 * | 11/2006 | Shahin et al. | 166/380 |
| 2003/0079883 | A1 | 5/2003 | McCulloch | |
| 2003/0098150 | A1 | 5/2003 | Andreychuk | |
| 2005/0082064 | A1 | 4/2005 | Foster | |

* cited by examiner

*Primary Examiner*—Shane Bomar
(74) *Attorney, Agent, or Firm*—Michael Flynn; David Cate; Robin Nava

(57) ABSTRACT

The present invention provides a rig capable of both coiled tubing and conventional drilling. The rig comprises a mast unit having a drilling mast and a catwalk. The mast unit is adapted for rotary drilling and casing operations. The rig further comprises a drill floor unit adapted to house a drilling cabin and hold a drilling BOP stack while in transport. The rig additionally comprises a coiled tubing unit that is controllable from the drilling cabin.

5 Claims, 4 Drawing Sheets

COILED TUBING DRILLING RIG

This application claims the benefit of U.S. Provisional Application No. 60/682,560, filed May 19, 2005, and U.S. Provisional Application No. 60/691,301, filed Jun. 16, 2005.

FIELD OF THE INVENTION

The present invention relates to coiled tubing drilling rigs. More specifically, the present invention is directed to a coiled tubing drilling rig adapted for transport in the US while retaining its operational efficiency.

BACKGROUND OF THE INVENTION

Coiled tubing drilling offers the advantages of reducing both time and costs associated with drilling operations. Reduced pipe handling time, pipe joint makeup time, and reduced leakage risks all attribute to the cost saving.

Although offering the above-mentioned advantages, there are instances where coiled tubing drilling has been unable to perform certain drilling operations and thus requires the assistance of a conventional rig. For example, there are instances where using coiled tubing to drill surface holes has proven difficult due to the lack of bit weight at the surface or shallow depths. When such circumstances arise, a separate and conventional rig is required to drill a surface hole, place surface casing, cement and then drill the vertical well portion. After drilling, a separate rig is brought in to run in the sectional and tubular production casing.

References such as U.S. Pat. Nos. 6,003,598 and 6,973,979 are directed to rigs aimed at performing all of the above described tasks from a single rig. These type of rigs, however, face obstacles in the US that arise from the inability to transport these large over weight units without falling outside of the "road legal" requirements set by the US Department of Transportation (DOT).

Accordingly, there exists a need for a coiled tubing rig that can easily be transported in the US while retaining its operational efficiency.

SUMMARY

An embodiment of the present invention provides a rig capable of both coiled tubing and conventional drilling. The rig comprises a mast unit having a drilling mast and a catwalk. The mast unit is adapted for rotary drilling and casing operations. The rig further comprises a drill floor unit adapted to house a drilling cabin and hold a drilling BOP stack while in transport. The rig additionally comprises a coiled tubing unit that is controllable from the drilling cabin.

Another embodiment of the present invention provides a method of performing drilling and casing operations at a well site with a drill floor unit, a mast unit, and a coiled tubing unit. The method comprises using the drill floor unit to center the drill floor over the well and raise the drill floor to operational height. The mast unit then raises the mast and v-door ramp to meet the drill floor. Finally the coiled tubing unit raises and scopes the injector to meet the drill floor and align the injector over the well center.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention is directed to the packaging and operation of a three piece coiled tubing drilling rig. The rig has been designed to maintain rig-up efficiency and keep equipment within DOT road legal dimensional limits.

The coiled tubing drilling rig of the present invention comprises a mast unit to house the drilling mast and catwalk trailer, a drill floor unit that houses the drilling blow-out preventer (BOP), drill floor and control cabin, and a stand alone coiled tubing unit designed to easily mate with the drill floor. It should be noted that in alternate embodiments, the drill floor can be mounted directly to the catwalk trailer or to a separate independent unit.

Figure 1:
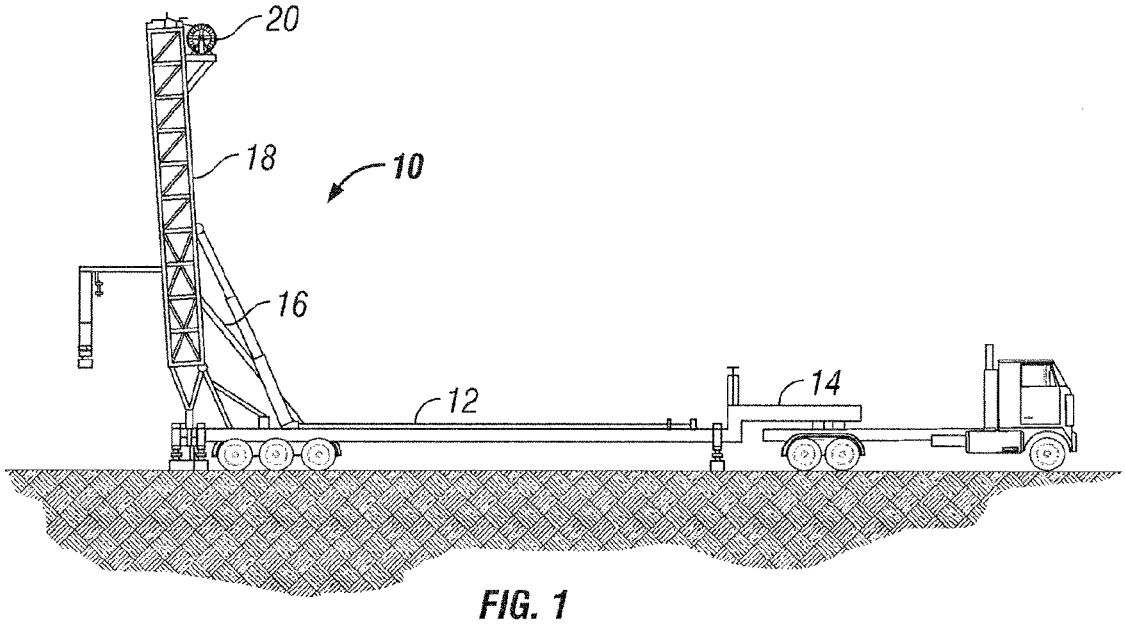
FIG. 1 is a side view of an embodiment of the drilling mast unit of the present invention.

FIG. 1 shows the general layout of an embodiment of the drilling mast unit 10 of the present invention. The mast unit 10 is designed to handle rotary drilling functions and casing operations. The rotary functions are performed with either a top drive or rotary swivel. Depending upon the operational circumstances, in some embodiments the top drive or rotary swivel are not transported with the mast unit 10 in order to reduce the unit cost and reduce the overall weight of the unit.

Figure 2:
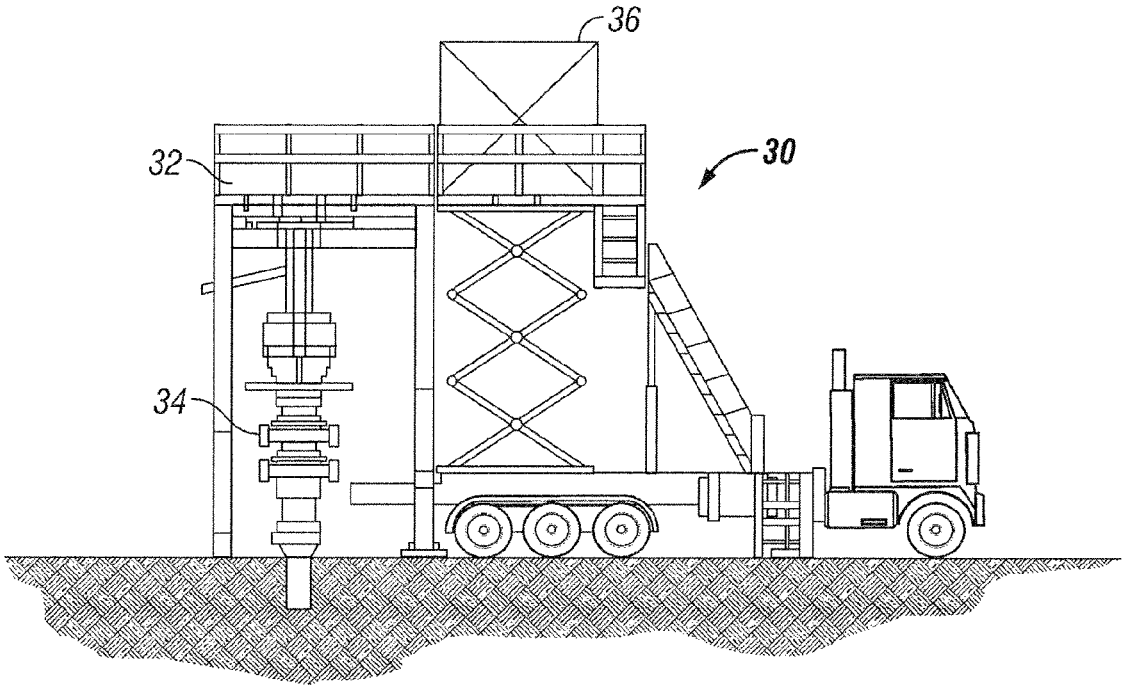
FIG. 2 is a side view of an embodiment of the drill floor unit of the present invention.

The illustrated embodiment of the mast unit 10 has the catwalk 12 integrated into the trailer 14 with a V-door ramp 16 or mechanical V-door ramp designed to mate with the drill floor 32 (shown in FIG. 2 and discussed below). The catwalk 12 has an automated skate system and rockers for ease of raising casing to the drill floor 32. The controls for the catwalk 12 are located within the drillers cabin 36 (shown in FIG. 2 and discussed below) and are operated by the driller. The catwalk 12 of the mast unit 10 has two pipe racks, one on each side of the catwalk trailer. One pipe rack is designated for casing while the other is designated for the bottom-hole assembly (BHA). Alternate embodiments include a pipe tub on one side of the drill floor for storage of drill collars, drill pipe and the BHA.

As illustrated, the mast 18 is a telescoping two column mast designed to align the rig block or top drive over well center and allow casing to be pulled through the mast 18 onto the drill floor 32. In an embodiment of the present invention, the mast 18 is equipped with a block and winch 20 (e.g. four-line block and winch). Preferably, the mast unit 10 is designed to be electric over hydraulic, which allows the unit to be operated by any hydraulic source with sufficient output.

A power swivel or a top drive system can be mounted in the mast 18 for rotary drilling applications. In such embodiments, the power swivel or top drive is mounted by supporting the power swivel or top drive in the blocks and installing a torque bar or cable into the derrick. The torque bar or cable is then anchored to the drill floor 32. The use of a top drive with a integrated block system can be used to eliminate the need for a typical rig four-line block.

An embodiment of the drill floor unit 30 of the present invention is described with reference to FIG. 2. The drill floor unit 30 is designed to hold a drilling BOP stack 34. For example, one specific embodiment provides an 11" 5,000 psi drilling BOP stack, which contains a flow cross, combination BOP, annular preventor and a bell nipple that is adapted for lubricator attachment. It should be understood that the present invention is not so limited to any size or makeup of the above described BOP stack.

During transport, the BOP stack 34 is pulled over the rear drive axles on a trolley system that also acts as a means to remove the drilling BOP stack 34 between completions for the installation of the next casing hanger. In a specific embodiment of the present invention, the travel height of the drill floor 32 is 13'6" with an installed height of 17'6". The extra height of the drill floor 32 is accomplished by parallelograming up the drill floor unit 30 by the use of hydraulic cylinders. Once at the work height, stabilization legs are lowered and pinned off for safety. Jacking the floor 32 allows enough room under the floor to remove the BOP 34 with up to three casing hangers installed and sufficient room to work over wellheads for re-drill applications. It should be understood that the above heights are provided as illustrative examples and not intended to limit the scope of the present invention.

The drill floor unit 30 contains tools for torquing the BHA or casing strings. Along with the tools, the floor unit 30 can be equipped with an API slip bowl for running casing. A separate slip bowl arrangement can be used for handling the BHA.

The drill floor unit 30 additionally houses the drilling cabin 36 to provide complete visualization of all operations. The drilling cabin 36 houses the controls for the coiled tubing unit 40 (discussed below), mast 18, catwalk 12 and mud system. The operation of the controls is discussed separately. The drilling cabin 24 is large enough to house multiple personnel (e.g. 5 personnel) and can be equipped with an exit on either side of the cabin 24 to the ground leading away from the unit 30. Space can be allocated, for example, for the coiled tubing operator/driller and a directional driller.

In an embodiment of the drill floor unit 30, the stairs and walkways ride on a track system that allows them to be easily assembled on location. Once the stairs and walkways are positioned, the cabin 36 can be jacked up into position with hydraulic cylinders. Manual locks can be used to support the cabin 36 once raised in the event of hydraulic cylinder failure.

In a further embodiment of the drill floor unit 30, a BOP accumulator system can be mounted below the stairs. This allows the BOP and BOP controls to remain plumbed during transport. The controls of the BOP can be integrated into the drilling control system and a remote panel can be used for operation outside of the cabin 36.

Figure 3:
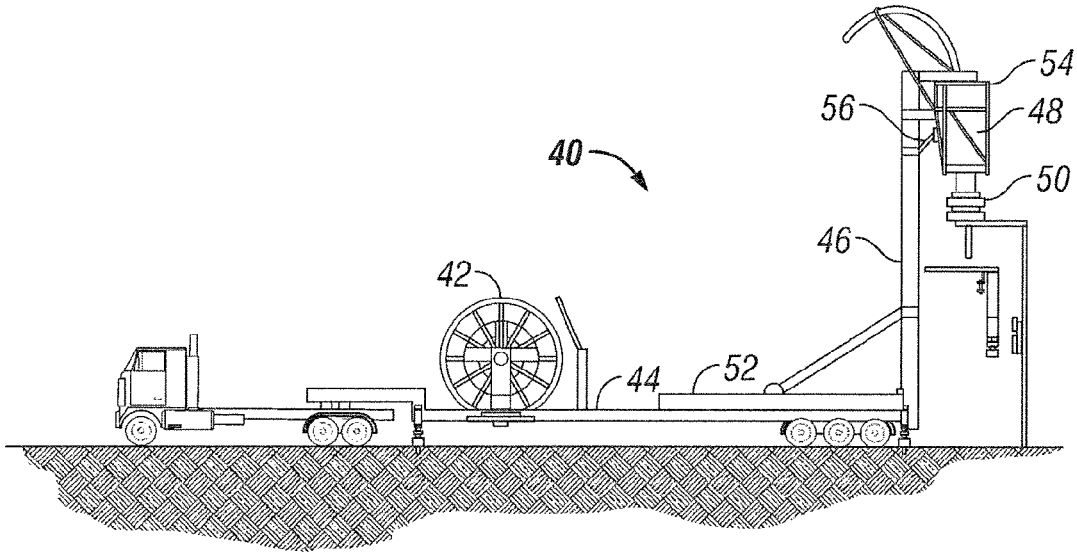
FIG. 3 is a side view of an embodiment of the coiled tubing unit of the present invention.

With reference to FIG. 3, an embodiment of the coiled tubing unit 40 can be a standalone unit that is controllable from the drillers cabin 36 during drilling operations. During standard coiled tubing operations the coiled tubing unit 40 can be controlled from the sleeper birth of the tractor, which has been converted to house the coiled tubing console. To reduce the cost of multiple control systems the control console can be removed from the coiled tubing console and can be placed directly into the drillers cabin 36. A single wire connection from the coiled tubing unit 36 to the drillers console is all that is needed to operate the entire coiled tubing unit 40.

The coiled tubing reel 42 of the present invention is a drop in drum style reel that uses the frame rails to directly support the reel drive system. In some embodiments, a drip pan can be incorporated into the trailer 44 to catch fluid as it comes off the pipe. In additional embodiments, the reel 42 can be equipped with a corrosion inhibitor system to prevent pipe corrosion during storage. Embodiments of the coiled tubing unit 40 may additionally comprise a pipe pigging system provided to remove water from the reel 42 prior to transport. Such water removal acts to ensure that water in the reel does not cause the unit 40 to be over weight.

In deeper drilling operations where the standard drum (e.g. 7000 ft of 2⅝" coiled tubing) may not be sufficient, the trailer 44 can be designed to accept an oversized drum. However, with the larger drum installed, additional over weight and over dimension permits may be required.

A mast 46 mounted on a trolley system 52 is used to deploy the injector 48 over the well. In transport mode the mast 46 straddles the reel 42 and the injector 48 rides at the base of the mast 46 with the BOP 50 installed. This allows the injector 48 to transport at road legal height with the pipe stabbed. Once on location the mast 46 is raised to vertical and the mast trolley system 52 scopes out to get the injector 48 over the well. In an example embodiment of the present invention, the mast trolley system 52 scopes out 3' to 4'. Keeping the mast 46 vertical makes it easier to get the injector 48 on and off the well during tool swaps.

In an embodiment of the present invention, the injector 48 is supported on a carriage 54 that provides for side shift left or right. In a specific embodiment, the carriage 54 enables side shift of approximately 6". Additionally, the carriage 54 of the present invention can further comprise a hydraulic cylinder 56 that adjusts the tilt of the injector 48 for un-level ground. The carriage 54 travels up and down the mast 46 hydraulically.

Figure 4:
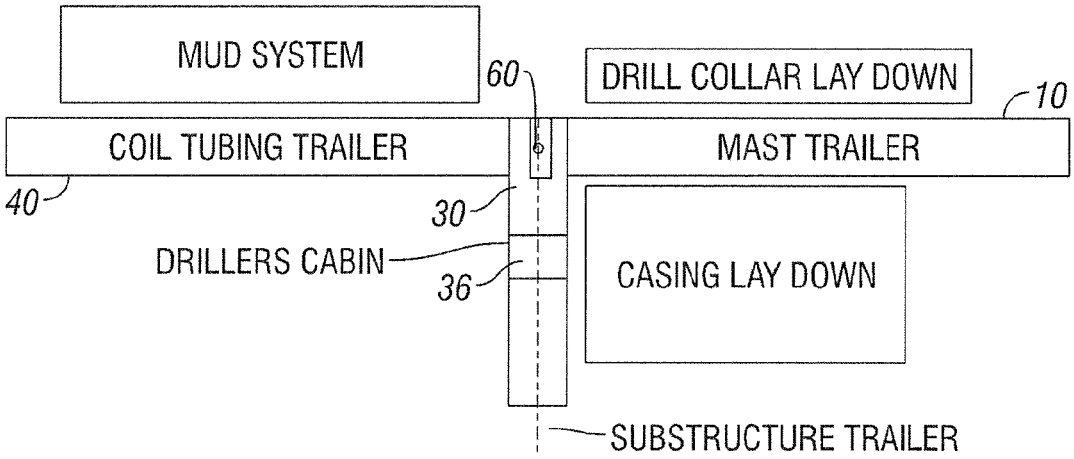
FIG. 4 is an overhead schematic view of a site layout of an embodiment of the present invention.

With reference to FIG. 4, an embodiment of the operation of the present invention is described. The first unit to pull onto location is the drill floor unit 30. The drill floor unit 30 centers the drill floor 32 over the well 60 and the floor parallelograms up to operational height. Once at operational height the stabilization support legs are lowered and the BOP stack 34 can be scoped forward and placed onto the conductor or surface casing head.

Once the drill floor unit 30 is properly aligned and spotted, the mast unit 10 is brought in and positioned with respect to the drill floor 32. The mast 18 is raised, which raises the v-door ramp 16 automatically to meet the drill floor 32. Pipe racks are unfolded from the sides of the trailer for handling casing and BHA components. With the embodiment of a mechanical v-door ramp the ramp is raised hydraulically to present the casing or drill pipe to the drill floor. A skate is used to push the casing up the ramp as it is raised.

The coiled tubing unit 40 is then brought in and is positioned opposite the mast unit 10. The coiled tubing unit 40 raises the injector 48 and scopes the injector 48 out to meet the drill floor 32 and align the injector 48 over the well center 60. The injector 48 can be scoped in and out to move off of well center for casing operations.

In the present invention, underbalanced tool deployment can be handled by slickline deployment methods. Slickline deployment uses wireline to lower the BHA into the well by the means of a lubricator section mounted on top of the BOP stack. Pressure is contained by the use of a slickline grease head. Once the BHA is lowered into the well the pipe and slip rams of the BOP are closed on a deployment bar located on the up hole end of the BHA. Pressure is then bled off of the lubricator section and the lubricator is removed to load the next section of BHA or to allow the injector head to connect to the BHA installed into the well. A slick line drum can be mounted on the coiled tubing unit 40 to prevent the need for a separate slickline truck from coming out just to deploy tools.

Figure 5:
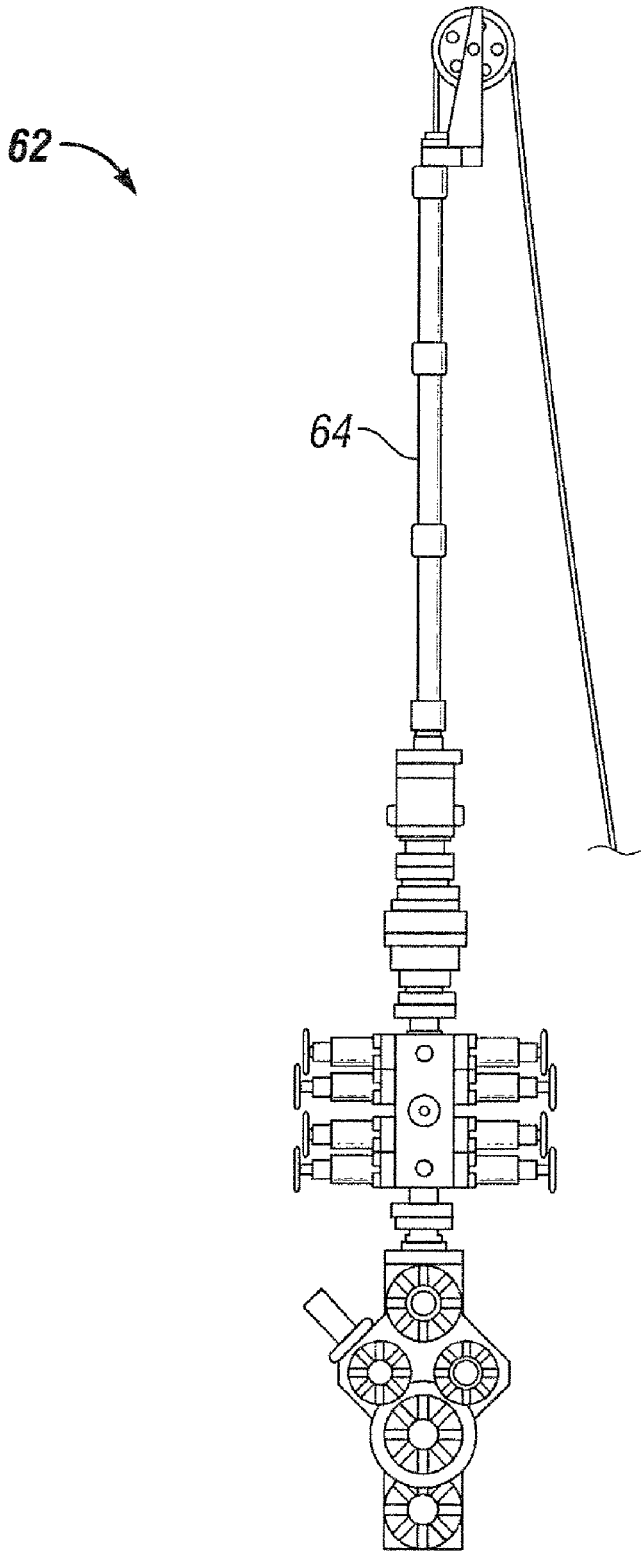
FIG. 5 illustrates an embodiment of a lubricator used in an embodiment of the present invention used for slickline deployment.
Figure 6A:
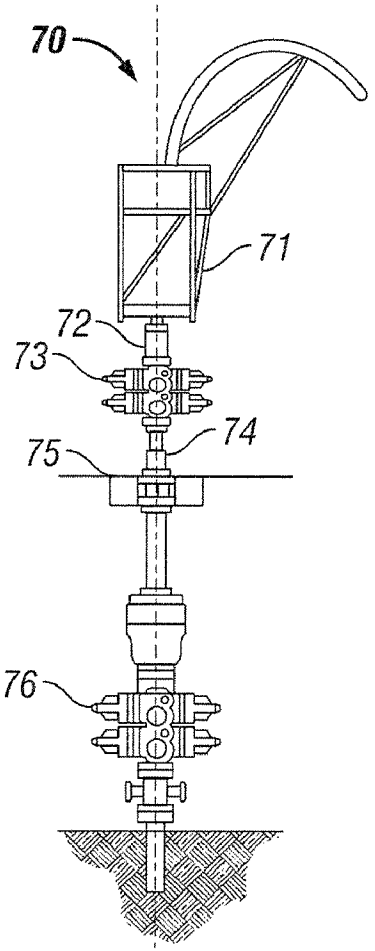
FIGS. 6A through 6D provide example configurations of BOP stacks utilized in embodiments of the present invention.
Figure 6B:
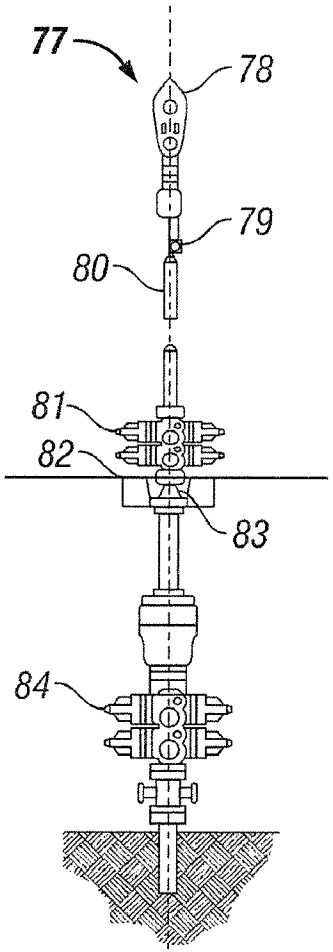
Figure 6C:
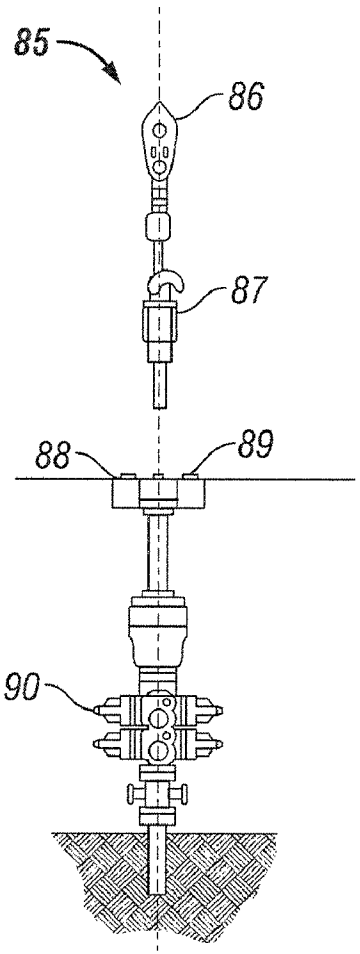
Figure 6D:
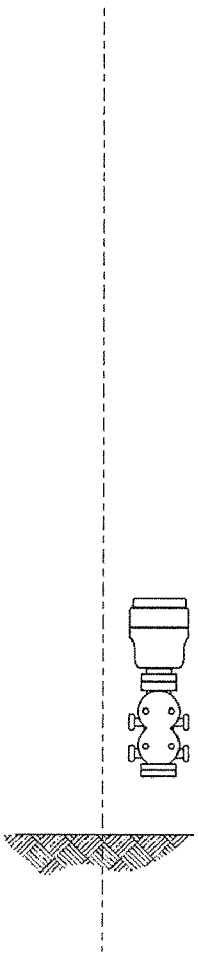

FIG. 5 below shows the general arrangement of a slickline deployment stack 62. Loading the BHA into the lubricator section 64 can be accomplished by installing the BHA horizontally on the catwalk 12. Once the BHA is installed the slick line is connected to the BHA and the grease head is connected to the lubricator 64. The lubricator 64 is then pushed up the v-door ramp 16 and captured by the rig elevators. The rig elevator and block assembly then pulls the lubricator 64 into the derrick and over the deployment BOP stack.

The lubricator is then connected to the BOP stack and the rig block supports the top of the lubricator 64. For each additional BHA section the lubricator is lowered back onto the catwalk 12 to be loaded.

FIGS. 6A through 6D provide example illustrations of various configurations of the BOP stack for different types of operations performed by the rig of the present invention. The example coiled tubing operation stack 70 comprises an injector 71, stripper 72, an upper BOP 73, a Hand Union 74, a slip bowl 75, and a BOP 76. The example wireline operation stack 77 comprises a block/hook assembly 78, a snatch block 79, a grease head 80, an upper BOP 81, a slip bowl 82, a Hand Union 83, and a BOP 84. The example drilling/running pipe operation stack 85 comprises a block/hook assembly 86, a power swivel 87, a slip bowl 88, slips 89, and a BOP 90. It should be understood that the examples of FIG. 6 should not be read to limit the scope of the invention but rather are intended to illustrate some of the many possible configurations of the present invention.

The control system for the coiled tubing drilling rig can be an electric over hydraulic system. By using an electric over hydraulic system the number of hydraulic connections that need to be made up prior to operation can be reduced and more functions can be automated to reduce human error. Examples of automated functions, include, but are not limited to, the following: Fly-by-wire—no hydraulic connections to operators console; Sealed control console; Injector speed control—cruise control; Injector slip control; Automatic and configurable pull tests; Automatic injector stop on over pull and snub; Skate & stripper pressure leakage detection and circuit isolation; Automatic reel tension adjustment (different RIH and POOH settings); Automatic reel brake release and set; Automatic tubing lubrication at the reel and stripper; BOP valve position monitoring; Power pack pump efficiency monitoring; Automatic pump management (supply on demand); Hydraulic injector creep mode; Automatic injector and reel stop in case of parted pipe on surface; Automatic emergency brake actuation on detection of reel drive chain failure; Hydraulic filter condition monitoring; Automatic engine shutdown on engine failure; Up to 4 camera video display; Pan-tilt-zoom camera available; and Potential for wireless connection from unit to control console.

The drilling controls of the present invention use a system capable of providing drilling operations controls such as: Drawworks; Mud pumps; Catwalk trailer; Choke manifold; Valves between active pits and reserve pits; Slips; Tongs; Power Swivel or Top Drive.

The data acquisition system of the present invention is used to generate and automatically update the drillers report. A key driver behind incorporating this feature is to allow the driller to easily complete a more accurate and complete report of the drilling process. The following is a list of items that can be incorporated into the drilling report: Time and date; Depth; Fluid rates; Pressures (wellhead, choke, pump); Pit volumes; Mud Density; Coiled tubing weight/calculated effective weight on bit; and Rotary weight on bit. By recording this data and providing a simple input path for entering non recorded data a more complete and comprehensive report of daily activities is kept.

Another embodiment of the present invention provides an alternate method of mast casing handling. In this embodiment, a two column drilling mast is mounted to a pipe trailer and is designed to allow casing to be pulled through the backside of the mast into the derrick. This eliminates the over weight problem associated with transporting the drilling mast as in typical coiled tubing drilling rig designs. Typical coiled tubing drilling rig designs mount the drilling mast on the coiled tubing trailer and bring out the pipe handling system separately. By mounting the mast on the pipe trailer the weight of the coiled tubing trailer is reduced significantly, which allows it to be transported easier. It should be understood that the two column drilling mast can be equipped with a top drive system and casing running tools.

In another embodiment of the present invention, the drill floor is provided via a separate truck along with the drillers console. This is another means of reducing the weight of the coiled tubing unit in comparison to existing coiled tubing drilling units.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A rig assembly capable of both coiled tubing and conventional drilling, comprising:

a mast unit having a drilling mast and a catwalk, the mast unit adapted for rotary drilling and casing operations;

a drill floor unit adapted to house a drilling cabin and further adapted to hold a drilling BOP stack in transport; and a coiled tubing unit having a coiled tubing reel and an injector, the coiled tubing unit controllable from the drilling cabin, wherein each of the units are individually transportable to distinct locations adjacent the other units and a well site for use in a drilling operation.

2. The rig of claim 1, wherein each of the units of the rig are within DOT road legal dimensional and weight limits.

3. A method of performing drilling and casing operations at a well site with a drill floor unit, a mast unit, and a coiled tubing unit, wherein each of the units are individually transportable to distinct locations at the well site, the method comprising:

locating the drill floor unit at a position at the well site;

using the drill floor unit to center the drill floor over the well and raise the drill floor to operational height;

locating the mast unit at the well site adjacent the drill floor unit;

using the mast unit to raise the mast and a v-door ramp to meet the drill floor;

locating the coiled tubing unit at the wellsite adjacent the drill floor unit and the mast unit; and using the coiled tubing unit to raise and scope a injector to meet the drill floor and align the injector over the well center, the coiled tubing unit further comprising a coiled tubing reel.

4. The method of claim 3, wherein each of the units is within DOT road legal dimensional and weight limits.

5. The method of claim 3, further comprising performing at least one of a drilling operation and a casing operation with the units.

* * * * *